US005850956A

United States Patent [19]

Hayward, Jr.

[11] Patent Number: 5,850,956

[45] Date of Patent: Dec. 22, 1998

[54] SUPPORTABLE FOOD TRAY WITH BIB

[76] Inventor: William C. Hayward, Jr., P.O. Box 156, Labadieville, La. 70372

[21] Appl. No.: 767,834

[22] Filed: Dec. 17, 1996

Related U.S. Application Data

[63] Continuation-in-part of Ser. No. 549,939, Oct. 30, 1995, Pat. No. 5,649,654.

[51] Int. Cl.[6] ..... A45F 5/00

[52] U.S. Cl. ..... 224/270; 224/575; 108/43; 220/602; 220/662; 220/737

[58] Field of Search ..... 224/270, 259, 224/575; 108/43; 220/575, 532, 602, 662, 737; 206/561, 565

[56] References Cited

U.S. PATENT DOCUMENTS

| | | | |
|---|---|---|---|
| 948,434 | 2/1910 | Scott | 220/575 |
| 2,107,381 | 2/1938 | Leppke | 220/575 |
| 2,125,856 | 8/1938 | De Witt | 220/532 |
| 2,719,413 | 10/1955 | Panzer | 220/575 |
| 3,835,281 | 9/1974 | Mannix | 220/575 |
| 4,346,813 | 8/1982 | Cho et al. | 220/532 |
| 5,353,952 | 10/1994 | Donche | 220/737 |

*Primary Examiner*—David J. Walczak
*Assistant Examiner*—Timothy L. Maust
*Attorney, Agent, or Firm*—Garvey, Smith, Nehrbass & Doody, L.L.C.

[57] ABSTRACT

An improved tray apparatus, which includes a single, flat, opaque surface having a border there around with the border accommodating a member positioned on the surface for dividing the surface into at least two or four compartments. The opaque surface would allow light to be transmitted through the surface when the tray was placed upon a lighted table or the like, so that food could be easily identified by the user.

5 Claims, 7 Drawing Sheets

SUPPORTABLE FOOD TRAY WITH BIB

CROSS-REFERENCE TO RELATED APPLICATIONS

This is a continuation-in-part application of U.S. patent application Ser. No. 08/549,939, entitled "SUPPORTABLE FOOD TRAY WITH BIB", filed Oct. 30, 1995, now U.S. Pat. No. 5,649,654 by the same inventor, currently pending and incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to food containers. More particularly, the present invention relates to a food tray which is positionable on the upper torso of a person, and includes a bib portion, so that a handicapped person may be given meals on the tray that is secured on his torso without having to sit at a table.

2. General Background of the Invention

In the care of the elderly, infirmed, or partial invalids, one problem that is particularly difficult to address is the problem of the person feeding himself or herself from a plate seated at a table. For example, if a person is unable to walk or move easily, it is quite difficult for a person to move from a chair or a position where the person may spend a great deal of time to a chair at a table or the like in order to eat meals. Additionally, for such people who are unable to move at all, or because of the lack of control that they may have in their limbs, they are unable to eat from a plate or the like while seated at a table. there is known in the art a type of a tray which serves as a plate also, because it is divided into component chambers for placing of certain items of food within each chamber. Such a tray, however, is the type that would be placed on the surface of a table so that a person may eat from the tray. This type of tray is often used in hospitals or school cafeterias.

However, there still presents the problem of the persons who are unable to sit at the table, yet requires that their food be placed in a type of a tray or plate which does have a partitioned off portion for the various components of food that they may choose to eat, without the person having to be seated at a table. Likewise, because often times a person, for example, with Parkinson's disease, is unable to have a steady hand as they move the food from their plate or tray to their mouth, food often falls from the eating utensil onto their upper torso or their lap, which is undesirable.

Therefore, there is a need in the art for a tray or plate which is partitioned to receive various components of food and/or drink on the tray, and would include a bib like portion for compensating for any food that may fall from a utensil down on the front of the person to be trapped by the bib and fall into the plate or tray. Likewise, it would be beneficial in the art to have this combination of tray and bib secured onto the front of the person so that the person does not have to move from what would normally be their seating to a table in order to eat.

Further, it would be beneficial in the art if there were a food tray designed so that the tray could be easily divided into separate compartments and in doing so could support a cup or glass in a central location for the user. Further, it would be beneficial if the tray included a base surface which would allow light to be transmitted therethrough so that food could be easily identified to a person with poor or failing eye sight. In a search done of the art, various patents were obtained as a result of the search, these patents are included in the prior art statement that is submitted with this application.

BRIEF SUMMARY OF THE INVENTION

The apparatus of the present invention solves the problems in the art in a simple and straight forward manner. What is provided is a tray member having an upper surface which is partitioned into a plurality of recessed container portions each of the portions containing a particular food item therein, and other recessed container portions for supporting a circular item such as a cup for drink; a bib portion extending upward at an angle from the rear edge of the tray, the bib portion of sufficient length to extend from the tray to the upper torso of the person; a pair of shoulder attachments secured to the bib portion, the shoulder attachments each including an upper arcuate arm member which would fit onto the shoulders of the wearer, the shoulder portions being adjustable vertically in order to compensate for the size of the wearer; and a rear extender portion likewise movable in a horizontal manner, the extender portion secured to the sides of the tray, and adjustable rearwardly in order to rest against the torso of the wearer, and maintain the tray portion positioned outward from the user, the adjustable shoulder portions and rearward extender portion providing vertical and horizontal adjustment of the apparatus for properly positioning on the wearer. there is further provided a liner, which includes a continuous plastic liner positionable on the tray, the liner conforming to the various chambers in the tray, and having a n upper portion conforming to the shape of the bib. The liner would be secured to the tray and bib via a continuous channel which conforms to the raised perimeter border extending along the outer edge of the tray and bib portion so that when the channel is secured upon the raised border, the liner is secured onto the tray and the bib.

Further, in an improved embodiment of the apparatus, the tray would be a single, flat, opaque surface having a border there around with the border accommodating a member positioned on the surface for dividing the surface into at least two or four compartments. The opaque surface would allow light to be transmitted through the surface when the tray was placed upon a lighted table or the like, so that food could be easily identified by the user.

Therefore, it is the principal object of the present invention to provide a food tray apparatus which is positionable on a wearer for allowing the wearer to be administered a meal without the person having to be seated at a table;

It is a further principal object of the present invention to provide a tray portion which is positionable on a wearer, the tray portion partitioned into a plurality of recessed container portions for food, and having a bib portion for preventing food from falling into the wearer's lap during a meal;

It is a further object of the present invention to provide an adjustable tray apparatus which is supportable on the shoulders of the wearer and has vertical and horizontal adjustment for proper placement on the wearer during use;

It is a further object of the present invention to provide a food tray which includes a bib portion, the tray and bib portion placed on the torso of a wearer, and having vertical and horizontal adjustment for positioning during a meal;

It is a further object of the improved embodiment of the present invention to provide a tray which may have a single surface without compartments but with a border there around or which may include a member for dividing the surface into multiple compartments wherein a cup or the like could be positioned thereupon;

It is a further object of the present invention to provide an improved embodiment which would include a tray surface made of an opaque light receiving materials so that when the tray was placed upon a lighted surface, light would filter through the support surface of the tray and allow food to be easily viewed thereupon.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
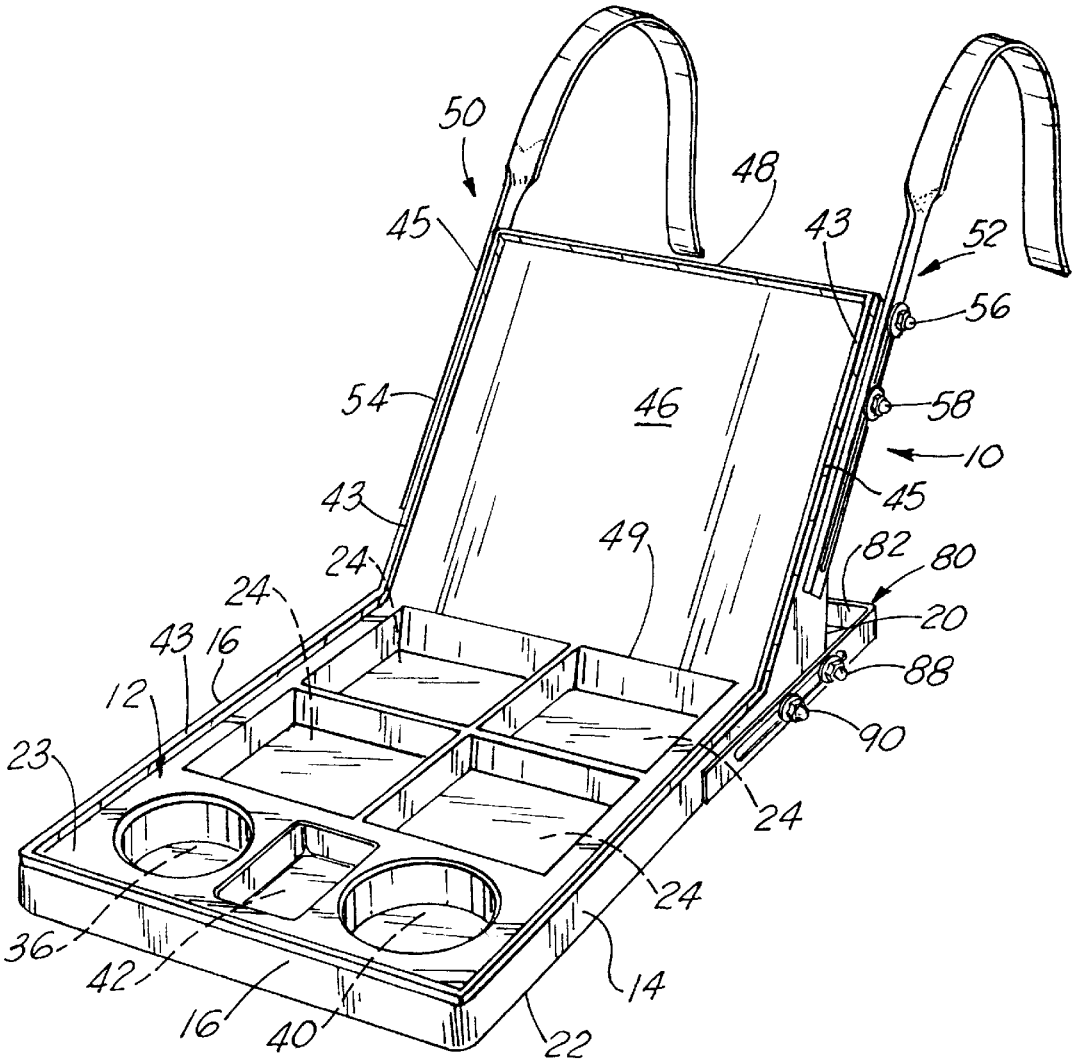
FIG. 1 is an overall perspective view of the preferred embodiment of the apparatus of the present invention.

FIGS. 1–6 illustrate the preferred embodiment of the apparatus of the present invention by the numeral 10. As illustrated in overall view in FIG. 1, apparatus 10 defines a tray portion 12, generally rectangular in shape and having a pair of sidewalls 14, 16, a forward wall 18, and a rear wall 20, each of the walls 14, 16, 18, 20 defining the rectangular tray 12 as illustrated in FIG. 1. The lower surface 22 (not illustrated) of tray 12 would be substantially flat, while the upper surface 23 would include a plurality of recessed rectangular openings 24, as illustrated. In the preferred embodiment, the openings 24 would be separated by divider walls 34 and 36, and defining four open-ended containers for placement of four different food items therein. Further, as illustrated, there is included a pair of recessed circular openings 38, 40, for allowing the placement of a circular container such as a cup or glass to be supported therein. As further illustrated, the tray would include a recessed forward opening 42, where there could be placed either sauce or butter container for use. As illustrated, tray 12 would have a certain depth along its four walls, to accommodate these various recessed openings so that a certain quantity of food could be placed within the openings 24 and the cups could be properly supported within the circular openings 38, 40. Further, as illustrated in the FIGURES, the tray would include a continuous perimeter border 43 extending along the outer edge of the tray, the function of which will be described further.

Figure 5:
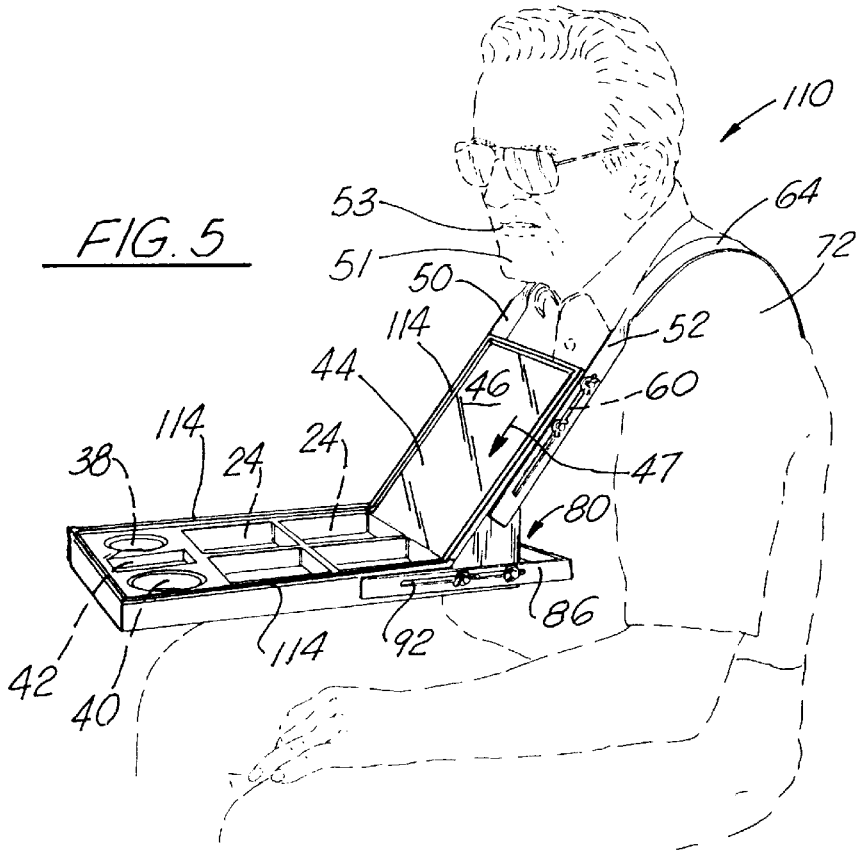
FIG. 5 is an overall view of the preferred embodiment of the apparatus of the present invention positioned on a person during use.

Turning now to the other components of the apparatus there is illustrated a rearward bib portion 44, which would include an upper flat surface 46, extending upward from the tray 12 at an angle of approximately thirty degrees from the vertical, and being of substantially the same width as the tray portion 12. In the preferred embodiment, as illustrated, the bib portion 44 would be an integral component from the tray portion 12 and would be constructed of the same material in a matter that may lend itself to being molded as one component with the tray 12. The bib portion 4 would extend upward at the approximate 30° angle to a height along its upper edge 48, so that the upper edge 48 would be secured near the level of the chin 51 of the wearer, as illustrated in FIG. 5, and the lower edge 49 would be integrated with the rear wall 20 of tray 12. As with tray 12, bib portion 48 would likewise have a continuous raised border 43 around its perimeter edge, and would be substantially integral and mate with the continuous edge 43 of tray 12, so as to define a continuous raised border around both tray 12 and bib 44 as illustrated in the FIGURES. As seen in FIG. 5, the important feature is that the bib portion 44 must be of sufficient height so that should food fall from an eating utensil between the tray 12 and the mouth 53 of the user, the food on its vertical drop would make contact with the upper surface 46 of the bib portion 44, and would then slide along the angulated bib portion 44 (arrow 47), into one of the containers 24 in the tray portion 12.

Figure 4:
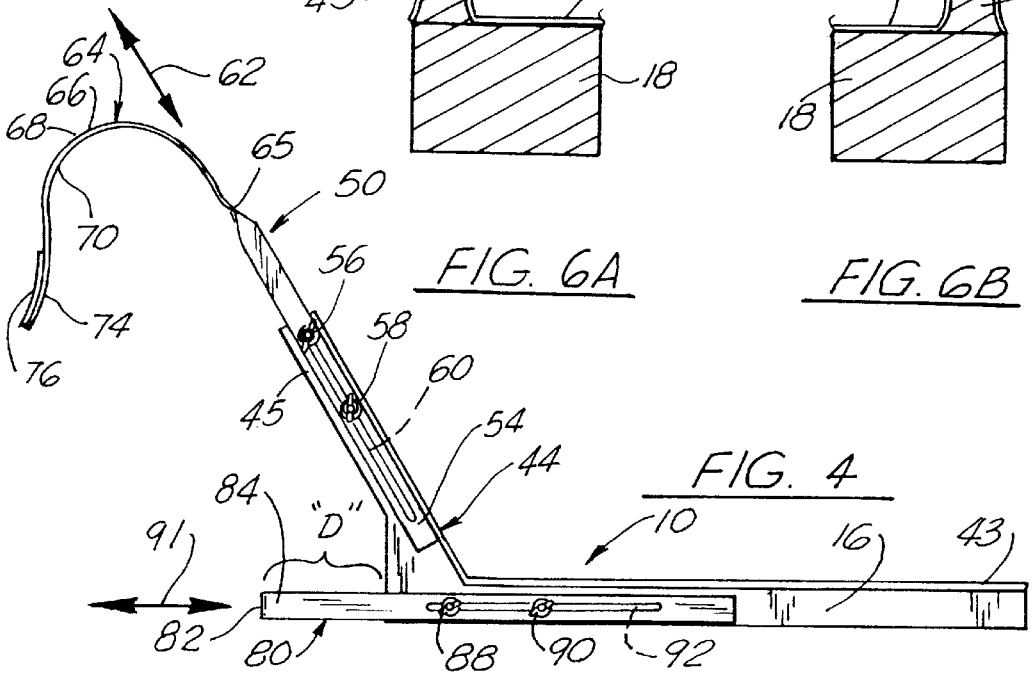
FIG. 4 is a side view of the preferred embodiment of the apparatus of the present invention.

In order to support the tray portion 12 and bib portion 44 on the wearer, reference is made to the shoulder support members 50, 52, as illustrated in the FIGURES. Shoulder members 50, 52 would include a pair of flexible metal or light weight members, having a pair of support end portions 54, which would be secured via bolts 56, 58 to each side wall 45 of the bib portion 44 as illustrated in FIGS. 1 and 4. As is clearly seen, particularly in FIG. 4, the bolt members 56, 58 would be secured into a continuous slot 60, running along the entire portion 54 of the shoulder supports 50, 52, so that the shoulder supports 50, 52 could be adjusted vertically in the direction of arrow 62 as seen in FIG. 4. This is important in view of the fact that since users, who would be of various sizes, may need the bib 44 and tray portion 12 supported at various heights along their torso, and therefore the slot 60 would allow the vertical adjustment of the shoulder supports 50, 52, for proper positioning on the wearer. Further, the shoulder supports would include a pair of arcuate portions 64, extending from the upper edge 65 of the supports 50, 52 and defining a pair of flat curved portions 66, having an upper flat surface 68, and a lower flat surface 70, the lower flat surfaces 70, resting upon the shoulders 72 of the wearer, as illustrated in FIG. 6, and securing the apparatus 10 in place.

For purposes of weight distribution, the far ends 74 of each of the shoulder support members 50, 52, would include a counter weight 76, which may be a length of heavy metal or the like, secured to the ends 74 of the shoulder portions 50, 52, for helping to balance the weight of the tray 12 and bib 44 that would be supported from the front of the wearer.

Turning now to an additional feature of the apparatus 10, reference is made to FIGS. 1 and 4, which illustrate a means for positioning the tray at a certain point distanced from the wearer. This means is a rear support member 80, which includes a transverse bar portion 82 running substantially along the width of the apparatus, and a pair of arm members 84, 86, which extend forward, and are secured to the side walls 14, 16 of the tray portion 12 via bolt members 88, 90. Like the shoulder supports 50, 52, the rear support portion 82 includes a continuous slot 92, wherein the bolts 88, 90 are secured, thus enabling the rear support portion 82 to be adjustable horizontally, in direction of arrow 91, so that as seen in FIG. 4, the tray 12 may be secured a certain distance "D" from the torso of the wearer, during use. This is important since some of the users may wish to have the tray moved outward or inward, depending on their preferences.

Figure 2:
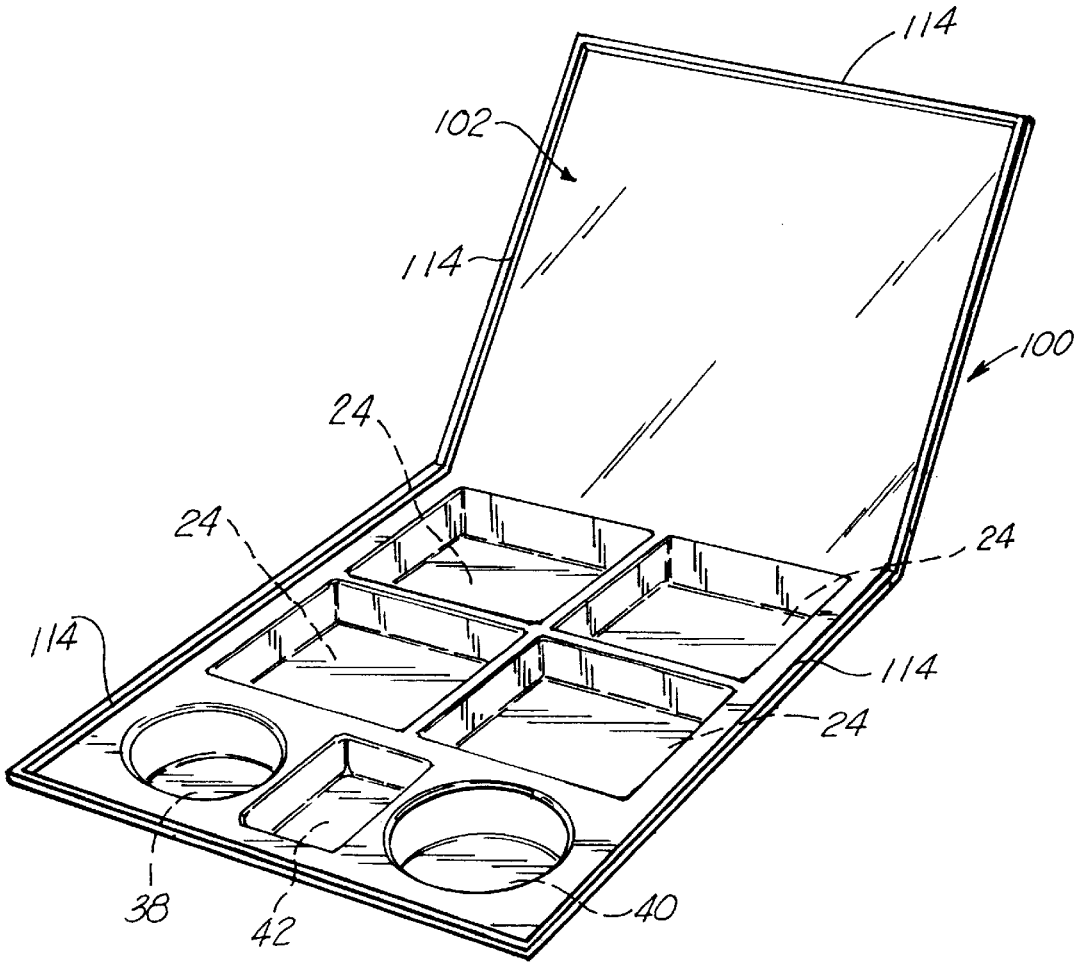
FIG. 2 is an overall view of the plastic liner utilized in the apparatus of the present invention.
Figure 3:
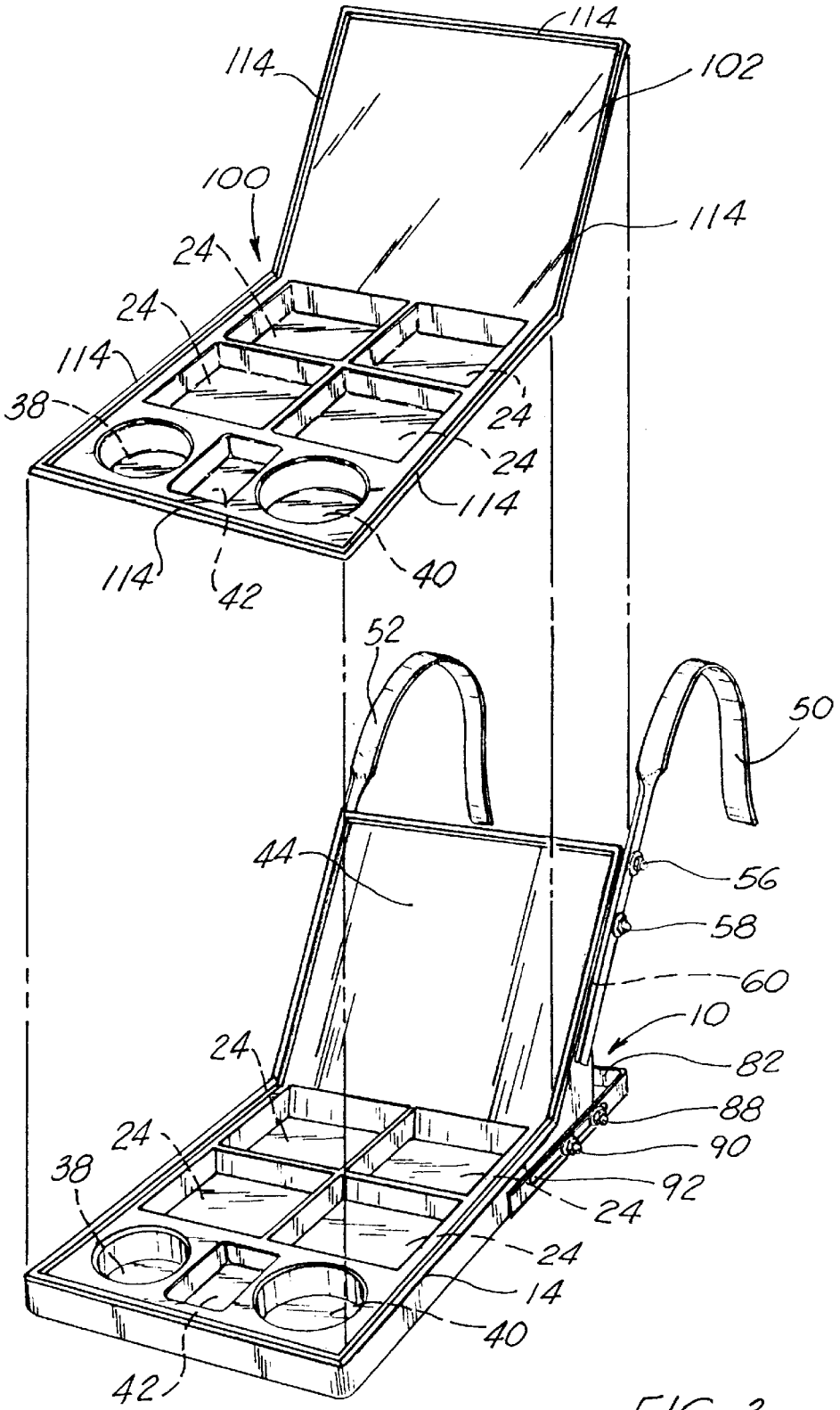
FIG. 3 is an overall perspective view of the apparatus of the present invention, illustrating the liner being positioned thereon.

An additional feature of the present invention includes a liner means 100, which is illustrated in FIGS. 2–3. Liner means 100 would be substantially of thin plastic which would have been molded to be placed upon the tray portion 12 and having the identical recessed containers 24, 38, 40, 42 formed therein for being slidingly engaged into the tray portion 12 in a manner as illustrated in FIGS. 2 and 3. Further, liner means 100 would include an integral bib portion 102, which would be placed upon the forward face 46 of the bib 44. In order to secure liner means 100 in place on tray 12, and bib 44, there would be provided a channel 114 formed along the outer perimeter edge of liner means 100, and configured so as channel 114 secures tightly along the entire length of raised border 43 of tray 12 and bib portion 44, so that when channel 114 is secured along raised border 43, the entire liner means is firmly secured along the outer edge of the liner 100 onto the tray 12 and bib portion 44 so as to maintain it in position.

Figure 6A:
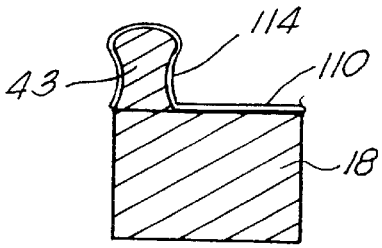
FIGS. 6A and 6B are cross-sectional partial views of the tray with the liner secured thereupon.
Figure 6B:
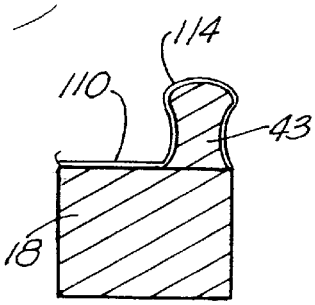

This securing of channel 114 along raised border 43 is seen more clearly in FIGS. 6A and 6B, which illustrate in partial cross-sectional view the manner in which the channel 114 is secured upon raised border 43, in order to secure the liner in place completely around its perimeter.

Therefore, once the liner 100 is in place as illustrated in FIG. 3, the food and drink could be placed within the liner 100 and after finishing the meal, rather than having to clean the tray portion 12, the liner 100 would simply be removed from the tray portion 12 and dispensed with, thus allowing the tray 12 and bib portion 44 to be used further without the additional step of having to clean it. As was stated earlier, preferably the liner would be a light weight molded plastic which would easily fit into the tray portion 12 and could be disposed of after use.

The entire apparatus is seen clearly in use in FIG. 5, where there is illustrated a person 110, wearing the apparatus for use. As illustrated, the shoulder members 50, 52 are positioned over the shoulder of the wearer 110, and the bib portion 44 is extending upward from the rear portion of the tray 12, to a point that should food fall from mouth 53 of the wearer 110, it would contact the bib portion 44 as seen by arrow 55. Further, the tray 12 is secured extending outward from the wearer 110, the tray 12 positioned in such a manner that the rear support member 80, has extended it outward from the wearer 110 to a position that the wearer 110 feels comfortable by adjusting along slot 92. Likewise, the shoulder supports 50, 52 have been properly adjusted along the continuous slot 60, so that the tray 12 is of the proper height for the wearer to feel comfortable in its use.

One additional function of the raised border 43 on tray 12 and bib 44, is in addition to securing the liner 100 in place, it would serve as a means for preventing food from sliding off of the upper surface of tray 12, if food were to be dropped onto that portion or would be pushed by the user out of the various containers 24. Instead of the food sliding off of the tray, the food would engage the upper raised portion 43, and would be maintained upon the tray 12 as indicated.

For purposes of use as was stated earlier, this apparatus could be used for the elderly and infirmed and particularly people who would have a difficult time maintaining food on their eating utensils such as sufferers of Parkinson's disease. Likewise, for people who are partially or totally blind, because of the nature of the containers positioned on the tray portion, a blind person would know exactly which container housed a particular food, and in doing so, could eat from the tray portion quite easily. Likewise, because of the bib portion, if the blind person would spill during eating, the food would make contact with the bib portion and would slide back into the containers of the tray portion. The tray would of course, be constructed of material that is as light weight as possible yet would be able to hold a quantity of food as illustrated, and would be easily cleaned whether it contained the plastic liner or one chosen not to utilize the liner in its use.

Figures 7, 8, 9, 10:
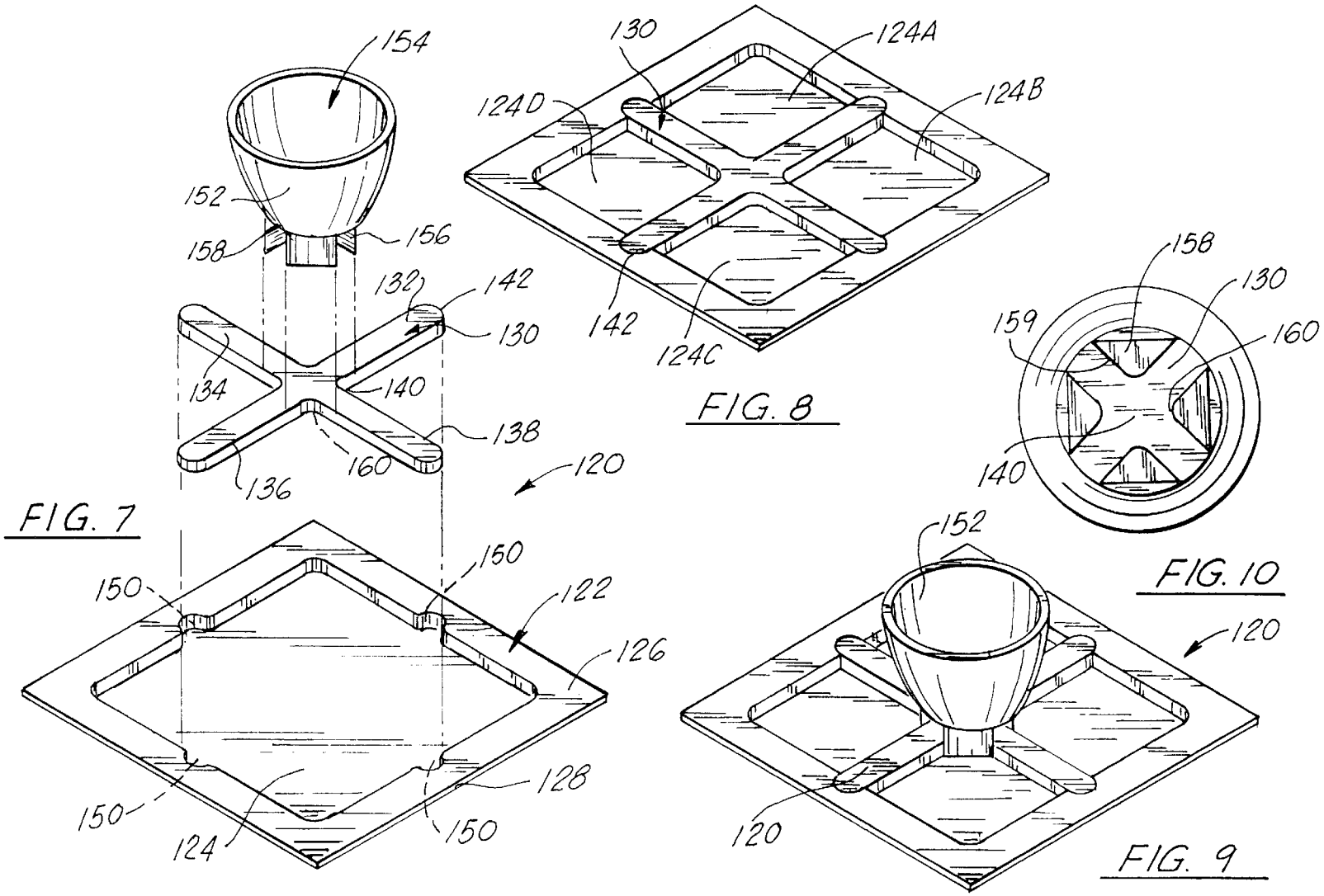
FIG. 7 is an exploded view of an additional embodiment of the apparatus of the present invention.
FIG. 8 is an overall view of the preferred embodiment of the additional embodiment of the apparatus of the present invention without the cup member set thereupon.
FIG. 9 is an overall view of the additional embodiment of the present invention with the cup member in place upon the tray.
FIG. 10 is a partial bottom view of the additional embodiment of the present invention illustrating the cup member positioned thereupon.

FIG. 7 illustrates an additional, improved embodiment of the tray 120 which would utilize a substantially rectangular or square flat tray portion 122 having a tray surface 124 for holding food or the like thereupon and a continuous border 126 around the perimeter 128 of the tray surface 122 for disallowing any food on the tray surface 124 from sliding there off. Further as illustrated, the improved version includes a composite cross-member 130 which includes four arms 132, 134, 136, and 138, each of which meet at a central portion 140 and terminate in a substantially rounded end portion 142.

As illustrated in FIG. 7 in exploded view, cross-member 130 would be positioned on the surface 124 of tray 122, and as seen in FIG. 8, upon placement thereupon, would redefine surface 124 into four compartments 124A, 124B, 124C and 124D. As further illustrated in FIGS. 7 and 8, when member 130 is lowered onto tray surface 124, each of the rounded ends 142, would be positioned within a semi-circular cut out portion 150 in each of the side members of border 126 so that the cross member 130 would be held in place by each of the ends 142, fixed therein as seen in FIG. 8, therefore, disallowing the member from moving around the tray. In this manner, a user of the tray who may have failing eyesight would be able to identify each of the four areas 124A through 124D where food would be placed.

In order to further ease the use of the tray member 120 by an elderly person who may have failing eyesight, there is a cup member 152 illustrated in the FIGURES, which includes an upper fluid receiving portion 154 and a base portion 156. As illustrated, base portion 156 includes a plurality of leg members 158 so configured that when cup member 12 is lowered onto the central portion 140 of cross member 130, the four leg members 158, would fit snugly within the four 90 degree angles 160, defined by the juncture of each of the four leg members. This is seen particularly clearly in the top view in FIG. 10 where you see a portion of the cross member 130 in position on the tray with the central portion 140 shown in bottom view and each of the legs 158 of the cup member is fitting snugly so that the walls 159 of each of the legs fit into the right angles as was stated earlier 160 formed by the cross members. In this manner, as seen in FIG. 9, the cup 152 is solidly supported onto tray 120 and can be easily grasped when the user with poor eyesight needs to know exactly where the cup is located and after use can be firmly and snugly placed in position on cross member 120 therefore avoiding any tilting of the cup which would result in spillage.

Figure 11A:
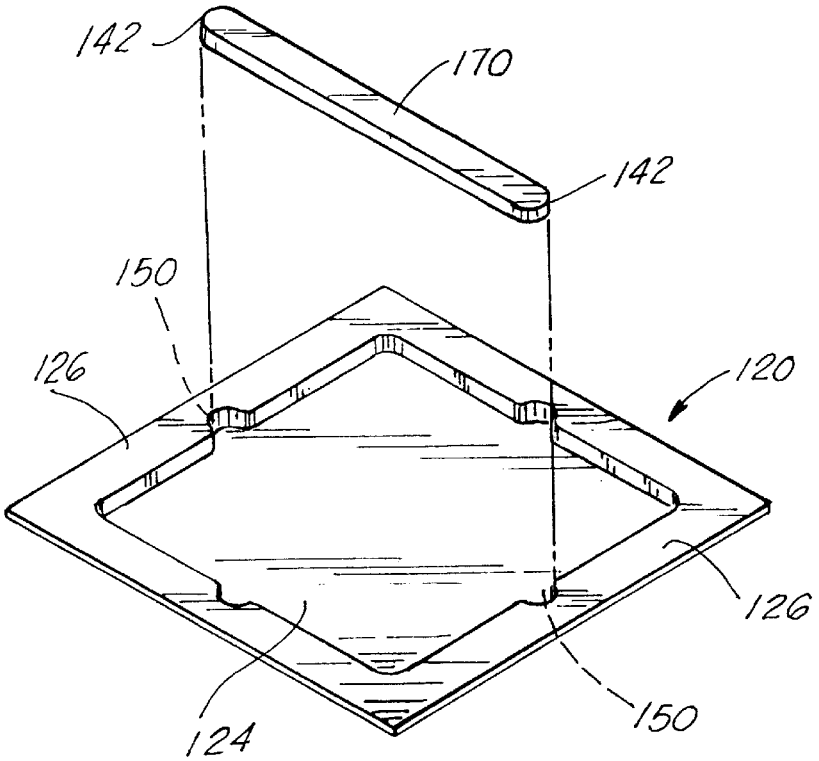
FIGS. 11A and 11B illustrate yet another embodiment of the present invention.
Figure 11B:
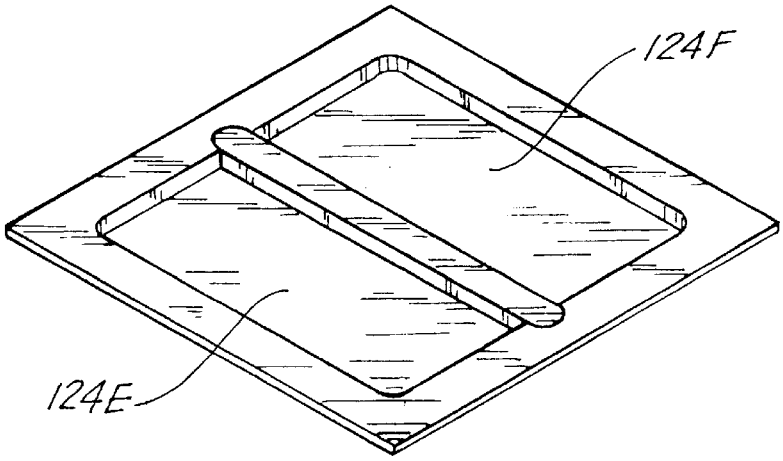
Figure 12:
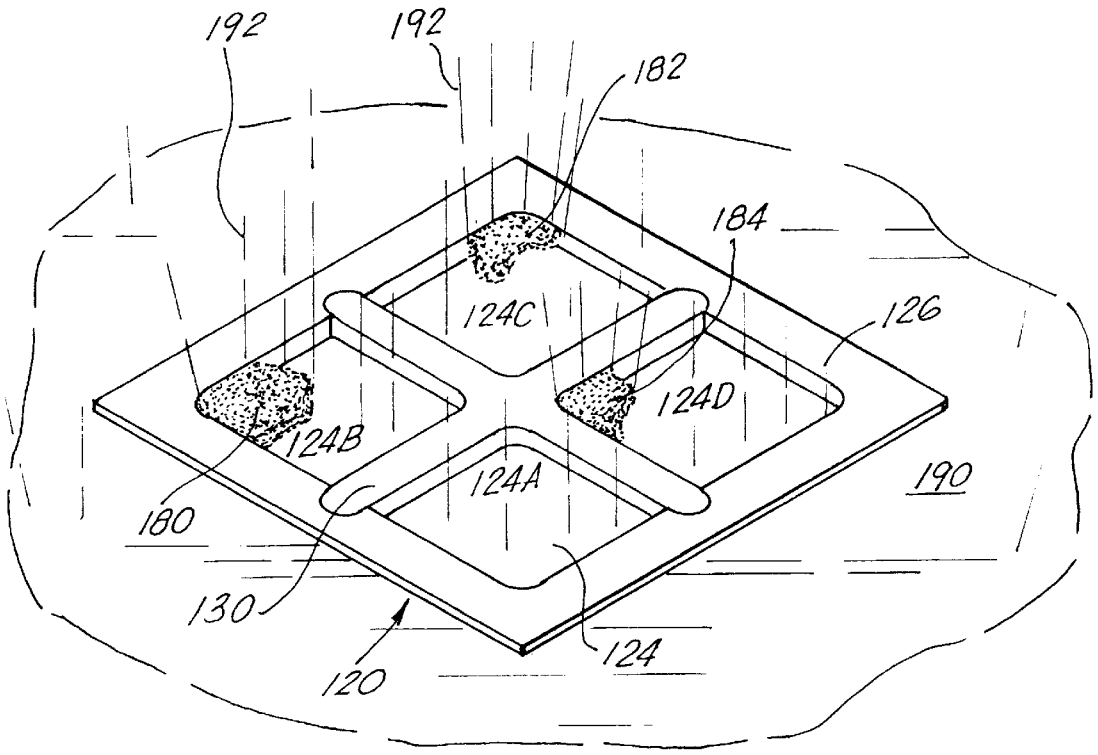
FIG. 12 illustrates an embodiment of the present invention with the tray surface constructed of an opaque plastic for allowing light to filter therethrough.

FIGS. 11A and 11B illustrate yet an additional embodiment of tray 120 that was illustrated in FIGS. 7–10. As seen in this FIGURE, again the tray surface 124 is a flat continuous surface having a continuous border 126 there around. As illustrated in 11A and 11B, there is a single cross member 170 which, rather than having four arms which would separate the tray surface 124 into four sections, it would be similarly a linear arm 170 which would fit substantially across the opposing borders 126 of tray 124, the rounded ends 142 of which again, like the embodiment shown in FIG. 7 would fit within the semicircular cut out areas 150 on the opposing borders and when in place, as illustrated in FIG. 11B, the tray would then be divided into compartments 124E and 124F rather than in the four compartments as was seen in FIG. 8. In this embodiment, the tray would simply be used for having two basic portions of food rather than four basic portions as was illustrated in FIG. 8. Turning now to FIG. 12, in this embodiment, there is a feature which may be employed which would result in yet an additional means for a user with failing eyesight to easily recognize food on the tray. Again, there is illustrated the tray 120 having the surface 124, in this case divided into the four surface areas 124A through D with the continuous border 126 there around and the multi-arm cross member 130 in place. Further, there is seen three items of food 180, 182 and 184, in each of the three compartments 124B, 124C and 124D respectively. In this particular FIGURE, there is seen a surface 190, upon which the tray 124 has been placed. The surface 190 may be a type of surface which would have an incandescent light fixture or the like which would shine through the surface in order to make it a lighted surface or there could simply be a lamp or the like underneath a table which would emit light upward through the glass surface 190 of the table 192. In this particular FIGURE, it is seen that the tray surface 124 is constructed of an opaque type plastic which would have the ability to receive light therethrough which is represented by the upper extending lines 194 throughout the FIG. 12 which represents light rays being emitted through the tray surface 124. In this manner, the user, again which would be a user with failing eyesight would be able to identify exactly where the food is in each of the particular compartments 124A through 124D and therefore it would be easy for the user to identify and eat the food on the tray. Of course, this type of lighted surface may be used on the tray whether or not it would be compartmentalized as seen in FIG. 12 or whether it would be departmentalized as seen in FIG. 11B or if there were no compartments, just simply the entire surface 124 could be lighted up for whatever food would be placed thereupon. In any event, it serves as an additional means for allowing one to view the food and make it easy to consume the food when one has failing eyesight.

Parts List

The following is a list of suitable parts and materials for the various elements of the preferred embodiment of the present invention.

PARTS LIST

| Description | Part No. |
|---|---|
| apparatus | 10 |
| tray portion | 12 |
| raised lip member | 13 |
| side walls | 14, 16 |
| forward wall | 18 |
| rear wall | 20 |
| lower surface | 22 |
| upper surface | 23 |
| openings | 24 |
| divider walls | 34, 36 |
| circular openings | 38, 40 |
| forward opening | 42 |
| raised border | 43 |
| bib portion | 44 |
| side wall | 45 |
| flat surface | 46 |
| arrow | 47 |
| upper edge | 48 |
| shoulder support members | 50, 52 |
| chin | 51 |
| mouth | 53 |
| support end portions | 54 |
| bolts | 56, 58 |
| continuous slot | 60 |
| arrow | 62 |
| arcuate portions | 64 |
| upper edge | 65 |
| flat curved portion | 66 |
| upper flat surface | 68 |
| lower flat surface | 70 |
| shoulders | 72 |
| far ends | 74 |
| counter weight | 76 |
| rear support member | 80 |
| transverse bar portion | 82 |
| arm members | 84, 86 |
| bolt members | 88, 90 |
| arrow | 91 |
| continuous slot | 92 |
| liner means | 100 |
| bib portion | 102 |
| upper edge | 106 |
| person | 110 |
| continuous channel | 114 |
| tray | 120 |
| flat tray portion | 122 |
| tray surface | 124 |
| border | 126 |
| perimeter | 128 |
| cross member | 130 |
| arms | 132, 134, 136, 138 |
| central portion | 140 |
| rounded end portion | 142 |
| compartments | 124A, 124B, 124C, 124D |
| cup member | 152 |
| receiving portion | 154 |
| base portion | 156 |
| leg members | 158 |
| 90 degree angles | 160 |
| single cross member | 170 |
| surface | 190 |
| table | 192 |
| lines | 194 |

The foregoing embodiments are presented by way of example only; the scope of the present invention is to be limited only by the following claims.

I claim:

1. An improved food tray apparatus comprising:

a) a food tray portion having a tray surface constructed of translucent material which has the ability to receive light therethrough, the surface further having a continuous border there around;

b) a removable ross-member positionable on the tray and extending that least across opposite portions of the border for dividing the tray surface into at least two separate compartments when the removable cross-member is positioned on the tray surface; and c) a source of light positioned beneath the tray surface so that light rays are able to flow upward through the translucent surface for identifying the location of food thereupon.

2. The apparatus in claim 1, further comprising a cross-member having multiple arms so that when the cross member is positioned on the tray surface, the tray surface is divided into at least four compartments.

3. The apparatus in claim 2, further comprising a fluid container having a base portion that is positionable on the multi-armed cross member after the cross member is positioned on the tray surface, for supporting the fluid container thereupon.

4. An improved food tray apparatus comprising:

a) a food tray portion having a tray surface constructed of translucent material which has the ability to receive light therethrough, the surface further having a continuous border there around;

b) a removable cross-member having multiple arms, each arm having an end portion thereof for engaging a notch in a portion of the continuous border, so that when the cross member is positioned on the tray surface, the tray surface is divided into at least four compartments, and the cross-member is unable to move along the tray surface; and c) so that light rays emitted from a source beneath the food tray would flow through the translucent surface for identifying the location of food thereupon.

5. An improved food tray apparatus comprising:

a) a food tray portion having a translucent tray surface able to receive light rays therethrough, and having a continuous border there around;

b) a removable cross-member having multiple arms, each arm having an end portion thereof for engaging a notch within the continuous border of the tray surface, so that when the cross member is positioned on the tray surface, the tray surface is divided into at least four compartments, and the cross-member is unable to move along the tray surface;

c) a fluid container having a base portion that is positionable on the central portion of the multi-armed cross member after the cross member is positioned on the tray surface, for supporting the fluid container thereupon; and d) a source of light positioned beneath the tray surface so that light rays from the source of light flow through the translucent surface for identifying the location of food thereupon.

* * * * *